US006839906B2

(12) United States Patent
Gold et al.

(10) Patent No.: US 6,839,906 B2
(45) Date of Patent: Jan. 11, 2005

(54) HIGH STRENGTH IMPACT RESISTANT KNEE PROTECTOR

(76) Inventors: Jerome Gold, 3632 Walnut Hill Rd., Virginia Beach, VA (US) 23452; Peter Krajian, 1400 Jefferson St. #3, Chesapeake, VA (US) 23324

( * ) Notice: Subject to any disclaimer, the term of this patent is extended or adjusted under 35 U.S.C. 154(b) by 92 days.

(21) Appl. No.: 10/684,824

(22) Filed: Oct. 14, 2003

(65) Prior Publication Data

US 2004/0103466 A1 Jun. 3, 2004

Related U.S. Application Data

(63) Continuation-in-part of application No. 10/230,118, filed on Aug. 29, 2002.

(51) Int. Cl.[7] ..... A41D 13/00
(52) U.S. Cl. ..... 2/24
(58) Field of Search ..... 2/24, 455, 267, 2/911, 22, 62, 23; 602/25, 26, 5, 62, 63

(56) References Cited

U.S. PATENT DOCUMENTS 2,188,718 A * 1/1940 Jung ..... 2/24
2,266,886 A * 12/1941 McCoy ..... 2/22
2,363,053 A * 11/1944 Facks ..... 409/65
3,189,919 A * 6/1965 Chase ..... 2/16
3,813,281 A * 5/1974 Chase ..... 428/51
4,914,753 A * 4/1990 Chang ..... 2/24
5,071,698 A * 12/1991 Scheerder et al. ..... 442/11
5,773,789 A * 6/1998 Devanathan et al. ... 219/121.64
5,781,935 A * 7/1998 Bassett et al. ..... 2/455
6,131,196 A * 10/2000 Vallion ..... 2/24

* cited by examiner

*Primary Examiner*—Tejash Patel
(74) *Attorney, Agent, or Firm*—Foley & Lardner LLP

(57) ABSTRACT

A joint protector of high strength impact resistant material is used for absorbing and dissipating energy from the high impact contact. The protector includes a preformed light-weight high strength material contoured to fit the joint. The preformed contoured material is covered with layers of impact absorbing padding and encased in an elastic cover. The high strength material is shaped to cover from 50–75% of the joint.

6 Claims, 3 Drawing Sheets

SIDE VIEW

TOP VIEW

HIGH STRENGTH IMPACT RESISTANT KNEE PROTECTOR

This application is a continuation-in-part of U.S. patent application Ser. No. 10/230,118, filed Aug. 29, 2002.

The present invention relates to a high strength impact resistant joint protector. Impact Resistant knee protectors have been discussed in the prior art. A few of these inventions and the advantages of the present invention will be discussed below.

Scheereder, U.S. Pat. No. 5,071,698 utilizes a woven metal mesh layer in which stainless steel wiring is used to form rings, in which form the mesh layer. The rings are welded jointed or soldered. Multiple rings form the layers. Scheerder also states that the size of the rings and weight of wire utilized vary in order to obtain adequate protection. Scheereder also states that his system for impact absorption, mitigates potentially bruising impacts provided that the metal mesh layer is free to move between the two fabric layers. This states that Scheerders method of impact absorption is effective contingent upon certain specific movements occurring within its makeup, and thus depending upon circumstances overall effectiveness at best adequate. In summary Scheerders method of impact absorption is based upon the usage of a metal mesh layer comprised of individual rings that are welded, jointed, or soldered to form its makeup. No similar materials, or method is utilized by the high strength impact resistant knee protector.

The product as mentioned by Devanthan describes a method of making an orthopedic implant having a porous metal pad. This is no manner similar to the high impact resistant knee protector, due to the fact that Devanthans method strictly and specifically applies to an orthopedic implant body, which is provided a supporting surface for the porous metal pad. In turn, the high strength impact resistant knee protector is strictly and specifically for use on a human knee. In addition, Devanthans method is clamped, adhesively bonded, or welded to the supporting surface, unlike the high strength impact resistant knee protector which provides a true slide on and off method. In summary, Devanthans method pertains to attaching a porous metal pad to specifically and solely an orthopaedic implant body. Devanthans method pertains to attaching a porous metal pad to specifically and solely an orthopaedic implant body. Devanthans method is in no manner similar to that of the high strength impact resistant knee protector whose primary and sole method is for usage on the human knee, with absolutely no clamping, bonding, or welding utilized.

Another comparison is the method of the composite flexible armor as claimed by Burgess U.S. Pat. No. 3,813,281. This method primarily consists of multiple platelets of different sizes arranged in multiple layers. This method relies upon the multiple platelets arranged in multiple layers to absorb impact energy. When the armor is struck, the impact force is absorbed in the first platelet layer, and then the first platelet layer struck bares against additional platelets in the next layer to spread the force of the strike over a large area. This is the physical principle of which the methods by Burgess is based upon, in addition to the spread of the impact force over a larger area, in arrangements of this type, different size platelets are required to ensure that the force will be spread over a large area and thus absorbed. Contrarily, the method utilized by the high strength impact resistant knee protector consists of a preformed high strength lightweight material to provide its impact absorbing properties. The knee protector does not rely upon multiple sheets or platelets strategically located in multiple layers working cohesively for its impact absorbing properties. The high impact resistant knee protector solely and simply relies upon the pre formed high strength lightweight material to comprise of its impact absorbing properties. Another impact absorbing physical principle of which the method described by Burgess is based upon, is having a compressible foam material interposed in between each platelet layer. When impact is made to the outermost platelet layer, the platelet moves rearward to compress the foam material. Gas is compressed and forced from the cells in the foam material to absorb and dissipate energy from the impact. Contrarily, the high strength impact resistant knee protector utilizes no similar method for its impact absorbing properties. The knee protectors impact absorbing property is solely based upon the preformed high strength lightweight material to absorb and dissipate energy from impact. In summary Burgess method of impact absorption is in no manner similar to that of the high strength impact resistant knee protector. While Burgess method of impact absorption is effective, its impact absorbing properties are based upon multiple materials and

BACKGROUND OF THE INVENTION

The present invention relates to a high strength knee protector, more particularly to a knee protector that withstands extreme high impact force. The purpose in creating the high strength impact resistant knee protector is to provide ultimate protection to the knee area against severe trauma. Throughout sports history, the most common and feared injury in contact sports in particular has been injury to the knee area and its major ligaments, such as the anterior cruciate ligament, (ACL) and meniscus ligaments due to trauma to this extremely sensitive area of the knee joint. The much exposed ACL ligament runs alongside the outer section of the knee. This ligament is extremely sensitive, and because of its location extremely vulnerable to injury. Throughout the history of modern sports knee injuries have resulted in the premature ending of careers of many prominent athletes. The kneepads athletes wear today offer minimal protection due to material make up and design. In addition the braces offered today provide minimal protection against unnatural and awkward movements of the knee joint, in such they keep the knee stabilized, but unfortunately these braces because of their complex design, offer the athlete minimal lateral movement, a maneuver crucial to many sports. In many instances these braces tend to wear very uncomfortable to the athlete, consequently on many instances, athletes prefer not to wear them in game situations which in turn further risks increased injury. Contrarily the high strength impact resistant knee protector provides a comfortable wear to the athlete, in which the athlete is able to perform any movement or maneuver as the athlete ordinarily would without protective gear worn. movements occurring within its makeup to ensure impact absorption. In conclusion, the high strength impact resistant knee protectors impact absorption method is in no manner similiar to the methods described by Scheerder,. Devanthan, or Burgess. The methods described by the preceding three are complex and offer adequate protection contingent upon circumstance.

BRIEF SUMMARY OF THE INVENTION

A high strength impact resistant knee protector for absorbing and dissipating energy from high impact contact. Includes a preformed high strength lightweight material contoured to the knee. The high strength lightweight material has been bent by machine, and angled to sufficiently cover 50%–75% of the circumference of the knee area. The high strength lightweight material is then covered with a foam padding of similar type material. An elastic sleeve is then sewn to form a pocket for receiving the material and padding. The thickness gauge of the high strength lightweight material is such that it offers strength and lightness of weight. The thickness of the padding material surrounding the high strength lightweight material should be sufficient to absorb impact and cushion the knee when wearing the high strength impact resistant knee protector. When contact is made to the outermost layer of the knee protector, the energy from the strike travels rearward from the outermost foam padding material and then is dissipated and absorbed by the high strength lightweight material. In accordance with a preferred arrangement, the foam materials for the foam layers comprise a high density tight cell foam material or similar type material.

BRIEF DESCRIPTION OF THE DRAWINGS

The invention may take form in certain parts and arrangements of parts, a preferred embodiment of which will be described in detail in this specification and illustrated in accompanying drawings which form a part hereof.

DETAILED DESCRIPTION OF THE INVENTION

Figure 1:
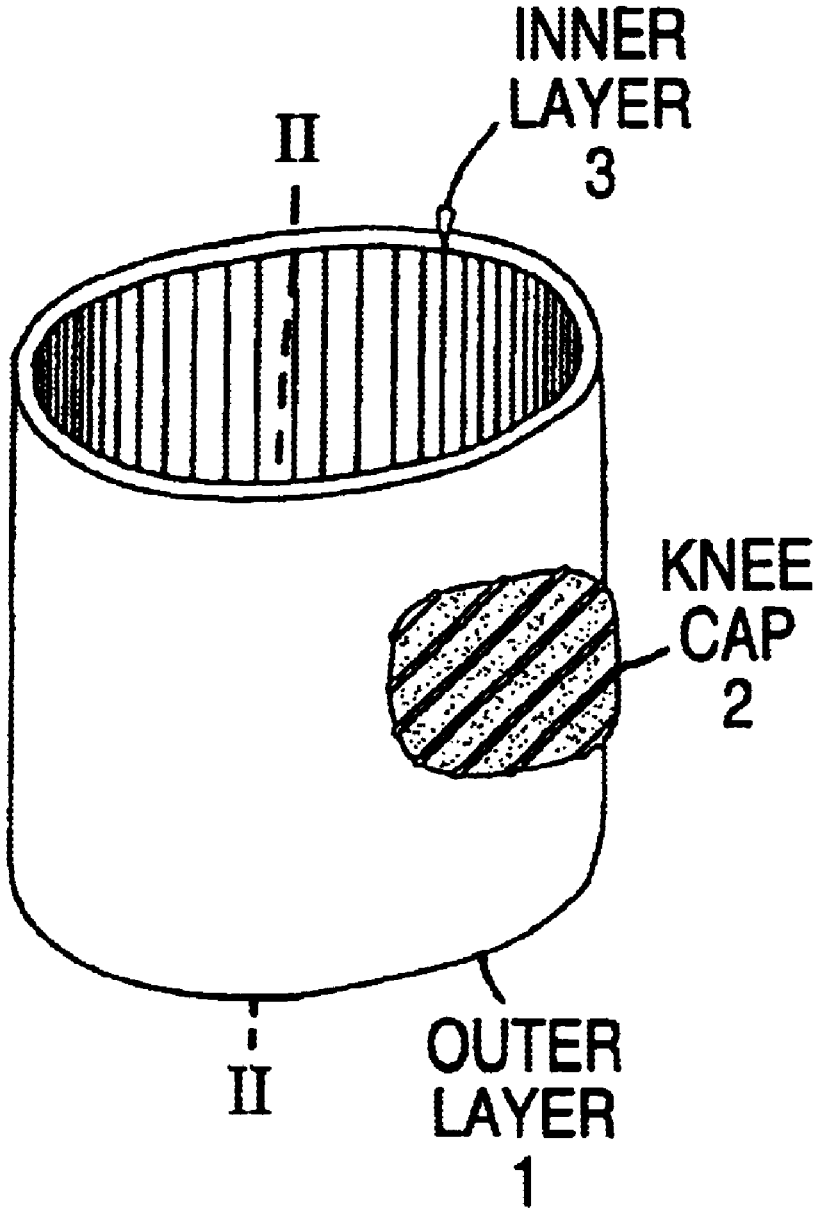
FIG. 1, is a perspective view of the knee protector in accordance with the present invention.

Referring now to the drawings and more particularly to FIG. 1.: There is shown an embodiment of a high strength impact resistant knee protector manufactured using the method of the present invention. In the embodiment shown, the knee protector consists of an elastic outer layer (1) which is comprised of a nylon or similar type material. Sewn onto the surface of the elastic outer layer is a knee cap cushion (2) which acts as an initial high impact absorber, thus dissipating energy prior to the impact energy reaching the pre formed high strength lightweight material, FIG. 2, 3 of which will be later elaborated upon further in detail.

Figure 2:
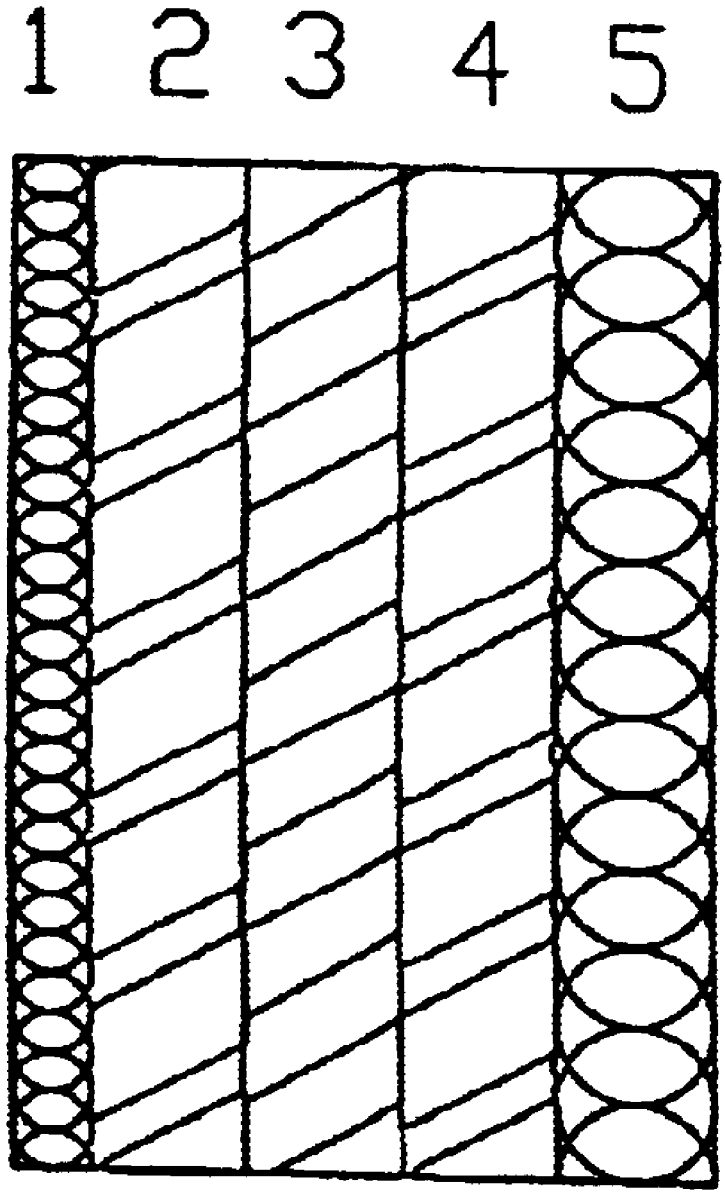
FIG. 2, is a cross sectional view of the knee protector @ line II—II
Figure 3:
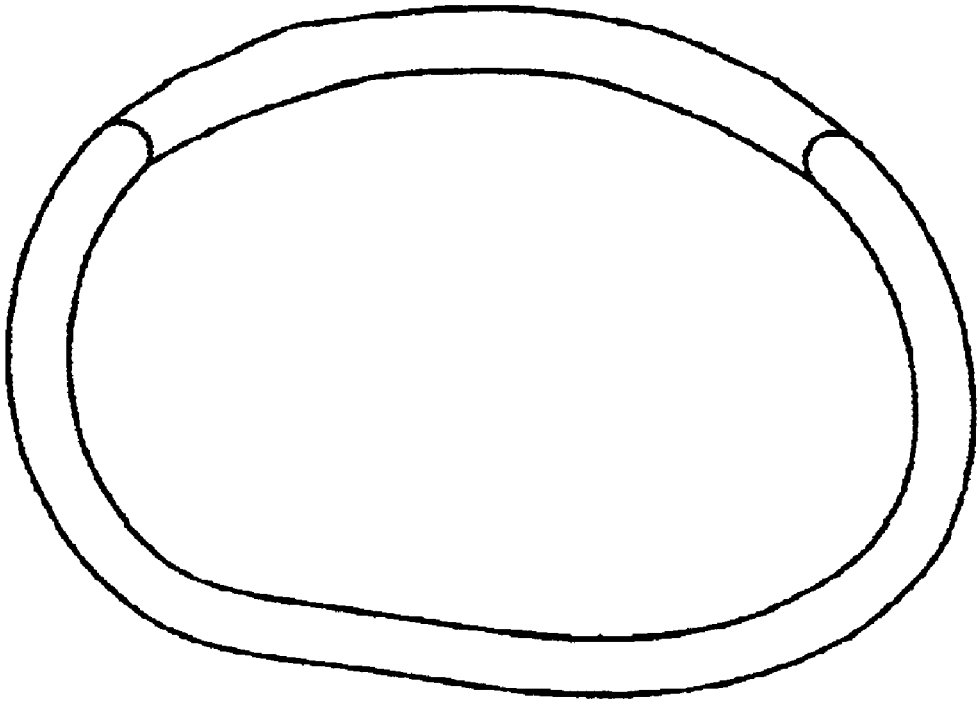
FIG. 3, is a top view of the knee protector showing the area of the knee covered by the protector.

The elastic outer layer is sewn to form a pocket for receiving the material and padding of which will be described herein after. The elastic inner layer (3) is consistent with the outer layer as to form a sleeve of which would slide on and off the leg to hug the knee. The elastic inner layer consists of a nylon material or similar type material thereof. FIG. 2 allows the view of the materials utilized to form the knee protector. FIG. 2, sections 1–5 represent the front and back layers of the knee protector. Covering the entire inner and outer sections of the knee where major ligaments are much exposed.

The outer and inner covers (1–5) consist of an elastic material or similar type material thereof. The padding consists of two layers (2, 4) of padding or foam type material thereof. The tubular cover of foam type material of (2, 4) is utilized to dissipate impact energy received from the outer layer, (1, 5) before reaching the inner layer. A preformed lightweight material that is chosen from the group comprising titanium, aluminum, stainless steel, hard plastic or similar impact materials (3) contoured to fit the knee is utilized to provide impact protection to the joint and to give strength to the protector. When formed and contoured the high strength lightweight material protects both sides of the knee, of which between 50%–75% of the circumference of the knee is covered. The high strength lightweight material acts as a shock absorber to dissipate any impact energy received from the outer layers. Foam type material padding (2, 4) are then adhesively bonded to the high strength lightweight material (3) using a high strength bonding adhesive, and is machine stitched to form a pocket surrounding the lightweight material of which is completely enclosed.

What is claimed is:

1. A high strength impact resistant knee protector comprising:

a single piece of preformed high strength, lightweight material that is contoured about the knee between 50% to 75% of the circumference thereof;

at least one layer of impact resistant foam padding secured onto a side of said preformed piece; and an outer cover having elastomeric qualities that forms a pocket that receives said preformed piece.

2. The knee protector of claim 1 wherein the foam padding is secured onto both sides of the preformed piece.

3. The knee protector of claim 1 wherein the high strength, lightweight material is titanium, aluminum, stainless steel, hard plastic or similar impact material.

4. The knee protector of claim 3 wherein the high strength, lightweight material dissipates impact force.

5. The knee protector of claim 1 adapted to slide up onto the knee and fit stationary onto the area of the knee without the aid of hinges, straps, screws or any similar device that can hinder lateral movement of the knee.

6. The knee protector of claim 1 wherein the foam padding is stitched or bonded to form a pocket for said performed piece.

* * * * *